US006204818B1

(12) United States Patent
Chang et al.

(10) Patent No.: US 6,204,818 B1
(45) Date of Patent: Mar. 20, 2001

(54) STRETCHABLE ANTENNA FOR MOBILE PHONES

(75) Inventors: Daniel Chang; Chi-Ming Chiang, both of Pa-Te (TW)

(73) Assignee: Auden Technology Mfg. Co., Ltd., Tao-Yuan Hsien (TW)

( * ) Notice: Subject to any disclaimer, the term of this patent is extended or adjusted under 35 U.S.C. 154(b) by 0 days.

(21) Appl. No.: 09/495,388

(22) Filed: Feb. 1, 2000

(51) Int. Cl.[7] ..... H01Q 1/24
(52) U.S. Cl. ..... 343/702; 343/895
(58) Field of Search ..... 343/702, 715, 343/725, 853, 867, 895, 900, 904; H01Q 1/24, 1/36

(56) References Cited

U.S. PATENT DOCUMENTS 4,435,713 * 3/1984 Gasparaitis et al. ..... 343/702
5,661,495 * 8/1997 Saldell ..... 343/702
5,764,191 * 6/1998 Tsuda ..... 343/702
5,771,023 * 6/1998 Engblom ..... 343/702
5,900,839 * 5/1999 Duperray ..... 343/702

* cited by examiner

*Primary Examiner*—Tho Phan
(74) *Attorney, Agent, or Firm*—Dougherty & Troxell

(57) ABSTRACT

A stretchable antenna for mobile phones including a fixed axle sleeve embedded in antecedent therein a fixed coil antenna, the axle sleeve forms requisite electric connection with the mobile phone on the body top of the latter, an antenna rod is freely moved to and fro in the axle sleeve and has on the top thereof an insulation end which is combined with a metallic end piece, a coil antenna is provided on the end piece, a metallic annular piece is provided beneath the metallic end piece; the shank of the antenna rod, the end piece, the annular piece and the coil antenna are enveloped with a coating by and positioned in injection molding, the bottom of the antenna rod connects a metallic sleeve; when the coil antenna is stretched, the end piece abuts on the annular piece to render the coil antenna to contact the antenna rod directly to form electric connection, when the antenna rod is retracted, extension of the antenna rod is limited by an abutting point to force the end piece to separate from the annular piece to eliminate coupling effect between the coil antenna and the fixed coil antenna.

2 Claims, 3 Drawing Sheets

STRETCHABLE ANTENNA FOR MOBILE PHONES

BACKGROUND OF THE INVENTION

1. Field of the Invention

The present invention is related to a stretchable antenna for mobile phones, and especially to a stretchable antenna capable of increasing capability of signal receiving and emitting.

2. Description of the Prior Art

A conventional antenna for mobile phones is divided mainly into two kinds; they are the quarter-wave and the half-wave antennas. The quarter-wave antennas have lower impedance in servo link, and do not need using of impedance transformers, but they are inferior to the half-wave antennas in the capability of signal receiving and emitting. The half-wave antennas have higher impedance, and need using of impedance transformers in the interior of their mobile phones.

In the recent years, mobile phones tend to be minimized. Half-wave antennas occupy larger space in their mobile phones by using impedance transformers; other redundant parts used further increase their costs. Lengths of half-wave antennas generally are hard to suit modern pocket mobile phones; such lengths are disproportional to the main bodies after assembling. In view of this, pocket mobile phones generally use quarter-wave antennas; however, quarter-wave antennas are evidently insufficient in the capability of signal receiving and emitting even when the rods of antennas as radiators are fully stretched.

In a "Antenna device for portable equipment" U.S. Pat. No. 5,757,325 granted to Saldell, an impedance transformer is evidently used.

In another U.S. Pat. No. 5,661,495 granted to Saldell, a technique is disclosed to use a switching device to separate a quarter-wave antenna when the antenna is retracted; however, it is still insufficient in the capability of signal receiving and emitting.

In another U.S. Pat. No. 5,771,023, a coil antenna for broad bands is disclosed, wherein, a broadband antenna is formed by connecting two coil antennas respectively with a rod of antenna.

A U.S. Pat. No. 5,650,789 provides a retractable antenna for an indoor wireless telephone set, of which two coil antennas are respectively used at the end of a rod of antenna and the telephone set. The coil antenna at the end of the rod of antenna is electrically broken when it is stretched out, but can form electromagnetic coupling with a fixed coil antenna on the surface of an engaging seat when the coil antenna at the end of the rod of antenna is retracted for signal receiving and emitting. This patent still cannot increase capability of signal receiving and emitting by using a quarter-wave antenna.

SUMMARY OF THE INVENTION

The present invention provides a stretchable antenna for mobile phones, wherein, a coil antenna is provided at the end of the rod of antenna which can be stretched to elastically combined with a rod of antenna when is stretched out. When the rod of antenna is retracted, the coil antenna at the end of the rod of antenna enters the interior of a fixed coil antenna in the body of the mobile telephone set in a limiting mode to decouple electromagnetically. Thereby, a stretchable antenna is completed; as a quarter-wave antenna, it can increase capability of signal receiving and emitting when it is stretched out.

In a preferred embodiment of the above stated coupling/decoupling device, an end piece is provided at the end of a rod of antenna. The end piece can be abutted against an annular piece by elastic stretching force of the coil antenna thereabove when the latter is stretched out. And when the rod of antenna is retracted, the bottom end of the coil antenna is limited to separate the end piece from the annular piece and out of contact therewith.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
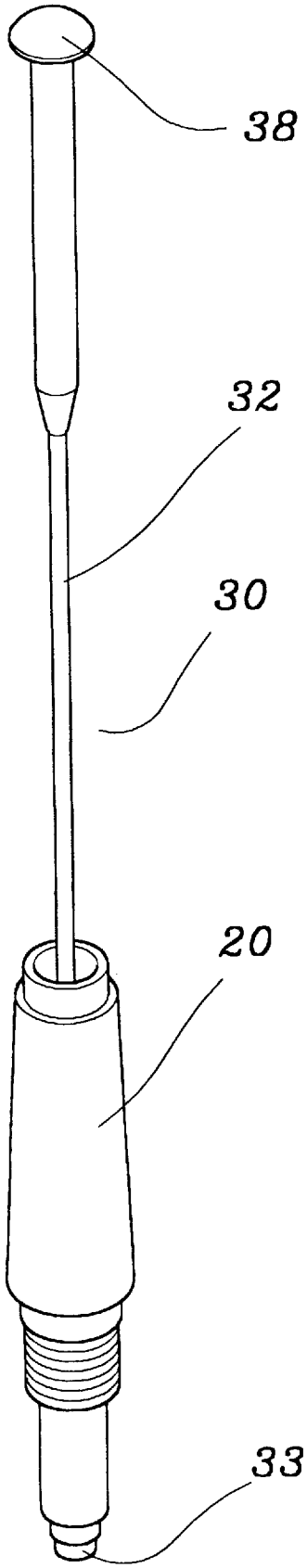
FIG. 1 is a perspective view showing a preferred embodiment of the present invention.
Figures 2, 3:
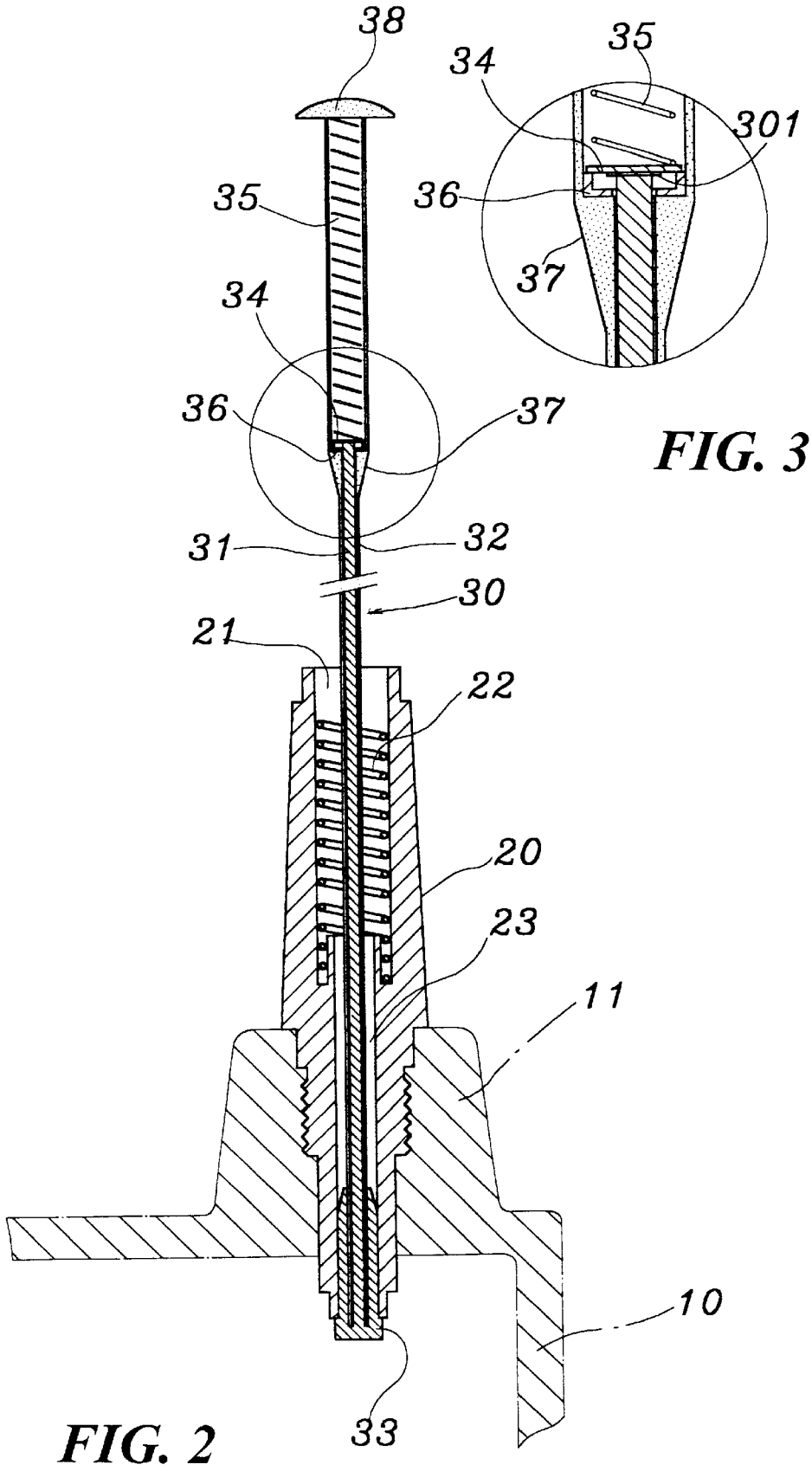
FIG. 2 is a sectional view showing the state of stretching of the embodiment of FIG. 1 when it is mounted on a mobile phone.
FIG. 3 is a partially enlarged view taken from FIG. 2.

Referring to FIGS. 1 and 2, the present invention is provided with a fixed axle sleeve 20 which can be assembled on a top seat 11 of a mobile phone 10, the axle sleeve 20 forms requisite electric connection with the mobile phone 10. An inner hole 21 having a specific depth in the axle sleeve 20 is embedded in antecedent therein a fixed coil antenna 22. A rod of antenna 30 is inserted into the inner hole 21 and another smaller hole 23 of the axle sleeve 20, so that it is stretchable and retractable in the axle sleeve 20.

The antenna rod 30 is a quarter-wave antenna, the shank 31 thereof is made preferably of Ni—Ti linear material, the assembly of the antenna rod 30 with related elements therefor is enveloped by injection molding with a coating 32, the bottom thereof is connected with a metallic sleeve 33.

As shown in FIGS. 2 and 3, the top of the antenna rod 30 is provided with an insulation end 301 which is combined with a metallic end piece 34; a quarter-wave coil antenna 35 is placed on the metallic end piece 34. A metallic annular piece 36 is provided beneath the metallic end piece 34 and is provided with a central hole for passing therethrough the antenna rod 30.

When the antenna rod 30 is stretched out as is depicted in FIGS. 2 and 3, tensile force of the coil antenna 35 renders the end piece 34 to abut against the annular piece 36, so that the coil antenna 35 contacts the antenna rod 30 directly to form electric connection. The antenna rod 30 which simply utilize the quarter-wave Ni—Ti shank 31 thereof as a radiator to receive and emit signals originally can obtain gain in signal receiving and emitting in a half-wave mode by cooperating with the quarter-wave coil antenna 35 getting direct electric connection.

Figures 4, 5:
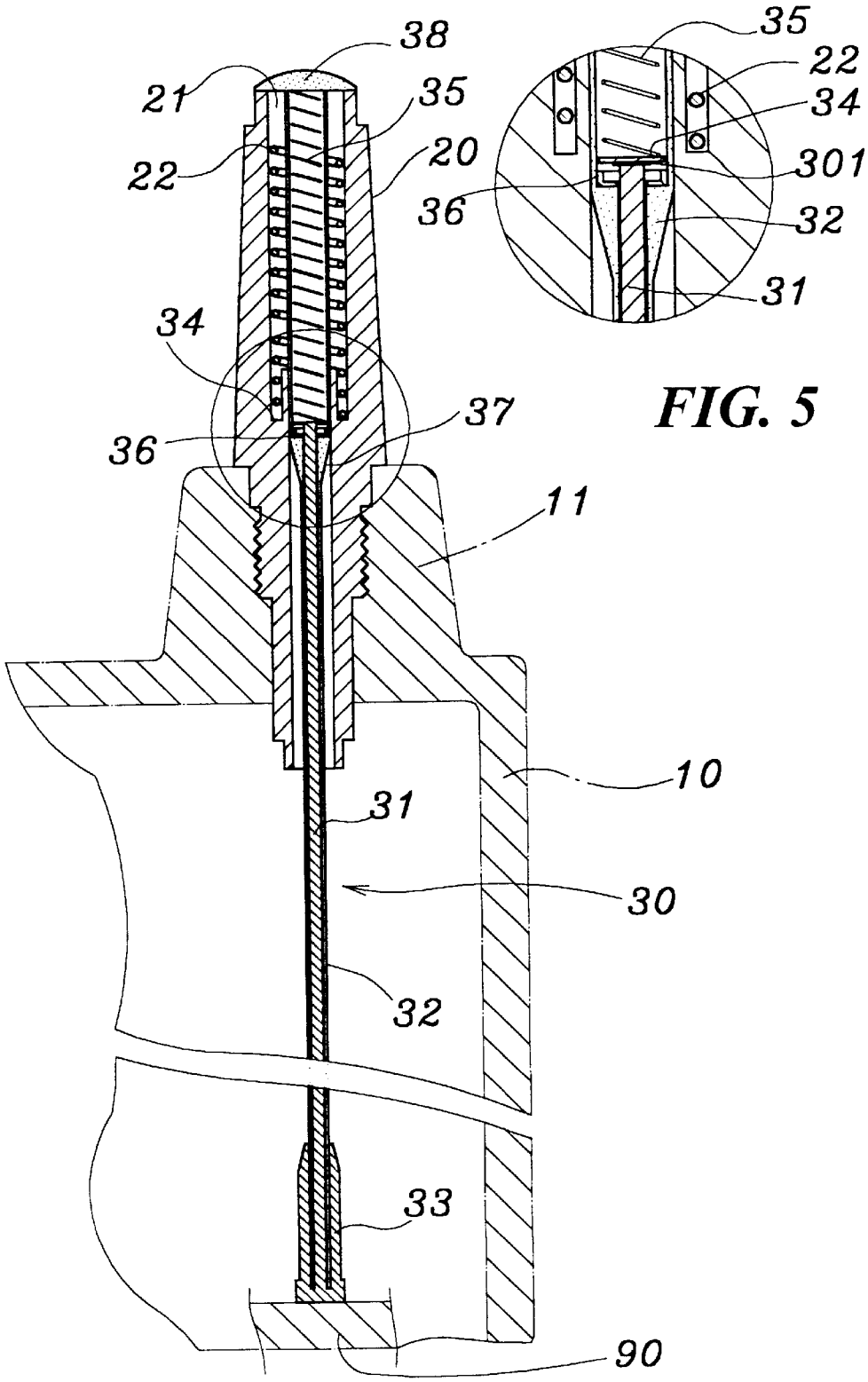
FIG. 4 is a sectional view showing the state of retracting of the embodiment of FIG. 2.
FIG. 5 is a partially enlarged view taken from FIG. 4.

When the antenna rod 30 is retracted as is depicted in FIGS. 4 and 5, the coil antenna 35 entering the fixed coil antenna 22 will generate coupling effect. To eliminate such effect, the antenna rod 30 of the present invention is provided on the bottom thereof in the telephone set with an abutting point 90, so that length of extension of the antenna rod 30 which is originally retractable wholly into the telephone set is now limited by the abutting point 90 to be pushed back slightly. Such a force of pushing back forces the end piece 34 to move up slightly, thereby, the end piece 34 and the coil antenna 35 thereabove are separated from the annular piece 36 to be no more in the state of electric connection.

When the antenna rod 30 is stretched out again after retracting, the bottom thereof is no more subjected to an abutting force, the compressed coil antenna 35 is stretched again to contact the end piece 34 with the annular piece 36 once more and the antenna rod 30 gets electric connection again as is depicted in FIGS. 2 and 3.

When the antenna rod 30 and other related elements of the present invention are enveloped by injection molding, the coil antenna 35 and the shank 31 are connected at the joint therebetween by a guiding bevel surface 37. And the top end of the coil antenna 35 is enveloped by integral shaping to form a top cap 38 for stretching or compressing.

The present invention overcomes and improves the inferior effect in signal receiving and emitting using quarter-wave coil antennas in modern pocket mobile phones when they are stretched out. The whole stretchable antennas get gain in signal receiving and emitting in their stretching state, and operation performance of the mobile phones can be improved.

The embodiments of the present invention cited herein are only for illustrating of the present invention, and not for giving any limitation to the scope of it. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

What is claimed is:

1. A stretchable antenna for mobile phones including a first fixed coil antenna embedded in a fixed axle sleeve, said axle sleeve forms requisite electric connection with a mobile phone, an antenna rod is freely moved to and fro in said fixed axle sleeve and is provided on the top thereof with an insulation end which is combined with a metallic end piece, a second coil antenna is provided on said end piece, a metallic annular piece is provided beneath said metallic end piece; a shank of said antenna rod, said end piece, said annular piece and said second coil antenna are enveloped with a coating by injection molding, the bottom of said antenna rod is connected with a metallic sleeve; when said second coil antenna is stretched out, said end piece abuts against said annular piece to render said second coil antenna to contact said antenna rod directly to form electric connection, when said antenna rod is retracted, the length of extension of said antenna rod is limited by an abutting point to force said end piece to move up slightly to be separated from said annular piece and out of electric connection.

2. A stretchable antenna for mobile phones as claimed in claim 1, wherein, said antenna rod and said coil antenna provided on said end piece are both quarter-wave coil antennas.

* * * * *